United States Patent [19]

Hogoboom

[11] Patent Number: 4,570,791

[45] Date of Patent: Feb. 18, 1986

[54] REINFORCED HANGING DISPLAY PACKAGE FOR WINDOW SHADE

[75] Inventor: David R. Hogoboom, Dover, N.J.

[73] Assignee: Cooper Industries, Inc., Houston, Tex.

[21] Appl. No.: 755,234

[22] Filed: Jul. 15, 1985

[51] Int. Cl.[4] ..... B65D 85/00

[52] U.S. Cl. ..... 206/326; 206/806; 53/396

[58] Field of Search ..... 206/326, 806, 303, 45.33; 53/396

[56] References Cited

U.S. PATENT DOCUMENTS

| | | | |
|---|---|---|---|
| 3,896,931 | 7/1975 | Franklin | 206/326 |
| 3,917,065 | 11/1975 | Pape | 206/326 |
| 4,111,297 | 9/1978 | Paulin | 206/806 |
| 4,166,532 | 9/1979 | Tsuchida et al. | 206/806 |
| 4,356,919 | 11/1982 | Matney | 206/470 |
| 4,456,122 | 6/1984 | Kalal | 206/45.34 |
| 4,469,226 | 9/1984 | Matney | 206/470 |
| 4,485,917 | 12/1984 | Smith | 206/806 |

*Primary Examiner*—Joseph Man-Fu Moy

*Attorney, Agent, or Firm*—Eddie E. Scott; Michael E. Martin

[57] ABSTRACT

A rolled window shade and a removable pulldown handle member are disposed in a display package comprising a elongated plastic film tubular envelope. The envelope is heat sealed at opposite ends and the handle member is oriented adjacent one end so that it is engageable with the heat seal and is provided with holes for inserting a support rod of a display rack and the like so that the shade may be hung in such a way that the handle member reinforces the envelope at its point of support by the support rod.

10 Claims, 3 Drawing Figures

REINFORCED HANGING DISPLAY PACKAGE FOR WINDOW SHADE

BACKGROUND OF THE INVENTION

1. Field of the Invention

The present invention pertains to a generally tubular plastic window shade display package including a window shade pulldown handle which serves as a reinforced support for hanging the package from a display rack, hook, or rod.

2. Background

In the merchandising of rolled window shades and similar products it is desirable to display the product in generally transparent plastic film packages which are preferably stored on a display rack of the type having a plurality of support rods from which the display packages are hung awaiting selection and purchase. Although plastic film packages are economical to produce and provide superior protection for the package contents prior to purchase the film must necessarily be relatively light weight and is therefore difficult to reinforce so that the package may support the weight of the package contents when being hung from a display rack or the like.

Conventional plastic film display packages are usually provided with a paper or cardboard reinforcement which is stapled to the display package and is provided with one or more holes therein so that the package may be hung from a display rack rod or hook. However, the process of packaging products such as window shades and other articles using the above mentioned type of prior art package is time consuming and results in a more expensive package. However, a unique solution to the above mentioned problem in connection with display packaging for rolled window shades and similar articles has been provided by the present invention.

SUMMARY OF THE INVENTION

The present invention provides a unique combination of a display package and contents for items such as rolled window shades and similar articles wherein a generally tubular plastic envelope type package is provided for the window shade and is reinforced for hanging from a display rack by the provision of a shade pulldown handle member positioned at one end of the package and provided with an opening for receiving a display rack rod or hook member. The package may be supported by a support rod or hook with minimal risk of tearing or damaging the package prior to selection and purchase of the product.

In accordance with one aspect of the present invention there is provided the combination of a rolled window shade disposed in an elongated generally tubular plastic film type package which is closed at both ends and contains a shade pulldown handle member disposed at one end of the display package in such a way that the package may be supported by the handle member to distribute the load on the plastic film due to the weight of the shade structure over a relatively large area.

In accordance with another aspect of the present invention there is provided the combination of a rolled window shade disposed in a heat sealed tubular plastic film package and having a generally curvilinear shaped shade pulldown member disposed in the package at one end thereof and arranged such that a generously curved surface of the shade pulldown member is engaged with a transverse heat seal for the display package and is provided with an opening for receiving a support rod or hook of a display rack. The package and its contents may be supported on the display rack in such a way that the weight of the package and its contents is distributed over a relatively large area of the plastic film to minimize the chance of tearing or damaging the package while it is on display or when it is removed for purposes of inspection and selection.

The present invention still further provides a method of providing a reinforced display package for a window shade and a removable pulldown handle member for the shade including the provision of an elongated envelope package for the handle member and the shade, inserting the handle member and the shade in the envelope, and closing the envelope to confine the shade and the handle member in such a way that the handle member is oriented to be engaged with means for hanging the envelope to display its contents.

Those skilled in the art will recognize the abovementioned features and advantages of the present invention as well as other superior aspects thereof upon reading the detailed description which follows in conjunction with the drawing.

DESCRIPTION OF THE PREFERRED EMBODIMENT

Figure 1:
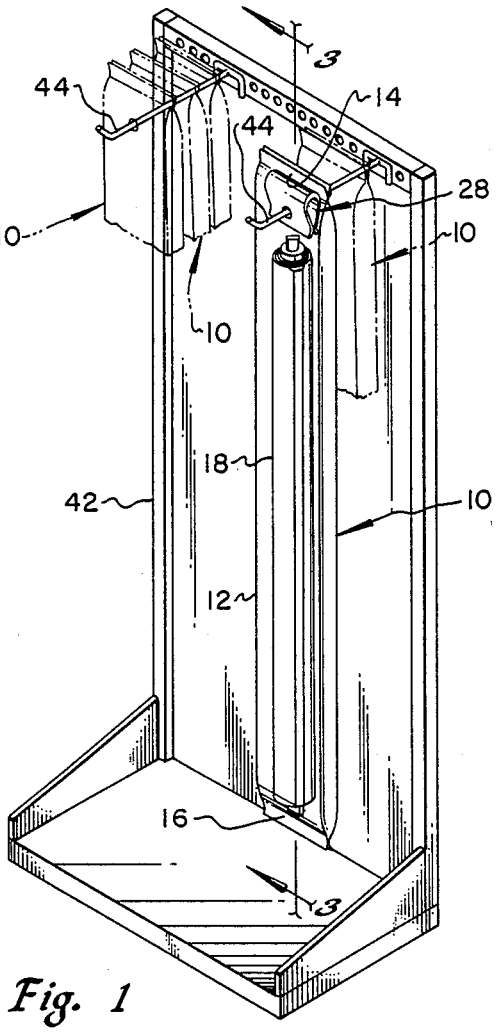
FIG. 1 is a perspective view of a merchandise display rack supporting a window shade and display package in accordance with the present invention.

In the description which follows like parts are marked throughout the specification and drawing with the same reference numerals, respectively. The drawing is not necessarily to scale and certain features of the invention may be shown exaggerated in scale in the interest of clarity.

Figure 3:
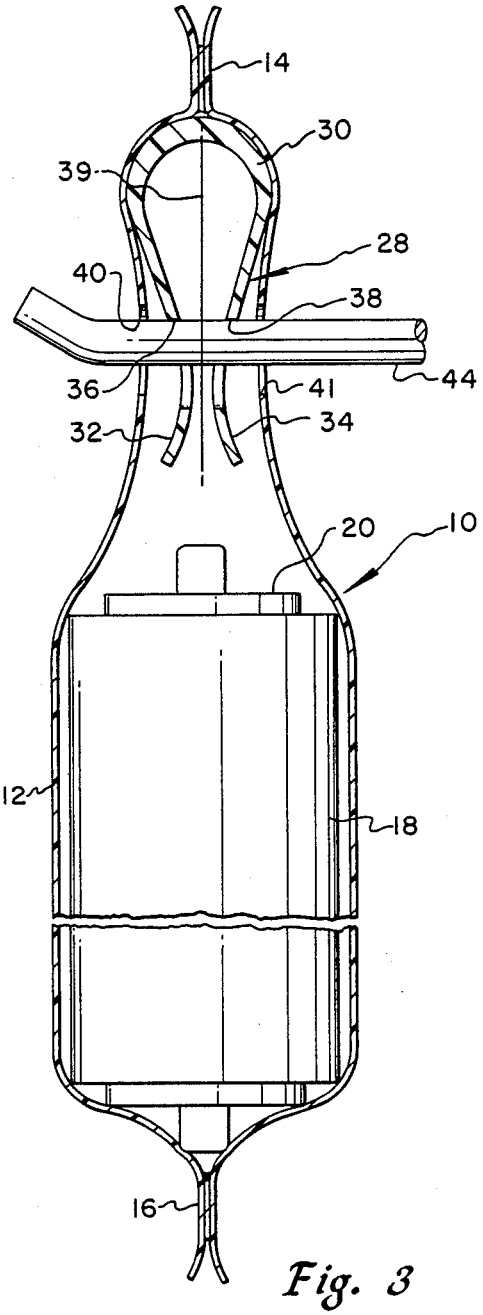
FIG. 3 is a detail longitudinal central section view of the window shade display package taken generally along the line 3—3 of FIG. 1.

Referring to the drawing, there is illustrated in FIGS. 1 and 3, a unique display package for a window shade and the like generally designated by the numeral 10. The package 10 comprises an elongated generally tubular envelope 12 perferably formed of heat sealable plastic film and is adapted to be closed at its opposite ends by generally parallel transversely extending seals 14 and 16. The package 10 is preferably formed of transparent heat sealable plastic film which is typically formed in a continuous blown tube and is heat sealed at its opposite ends to form the seals 14 and 16 after insertion of the package contents.

Figure 2:
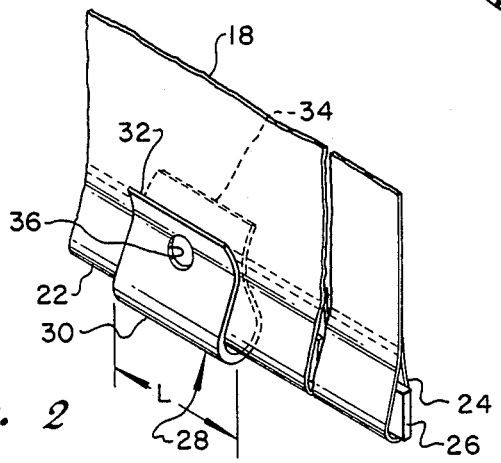
FIG. 2 is a detail perspective view showing the window shade pulldown handle member in its working position after removal from the display package and assembly with a window shade.

In accordance with the present invention the film tube 12 is of transparent plastic and is adapted to support and display a rolled window shade 18 formed of a suitable flexible material rolled on a roller 20, FIG. 3, and provided with an unrollable distal end 22, FIG. 2, having a hem 24 and a substantially rigid slat 26 disposed therein. The window shade 18 is of conventional construction and is not believed to require further detailed description in order to practice the present invention.

The window shade 18 does, however, include a uniquely modified shade pulldown handle member 28, FIGS. 2 and 3, which is preferably formed of molded plastic. The handle member 28 is preferably formed from a single piece of molded plastic which is shaped to have a generously curved base portion 30 and a pair of opposed, elastically deflectible jaw portions 32 and 34. The jaw portions 32 and 34 may be elastically spread away from each other to slip the handle member 28 onto the shade 18 at the hem 24 and over the slat 26 in a conventional manner. The handle member 28 is, however, modified to include aligned holes 36 and 38 formed in the respective jaw portions 32 and 34 as indicated in FIG. 3. For references purposes only the handle member 28 is indicated to have a plane of symmetry 39 which extends between the jaw portions 32 and 34 and intersects the longitudinal extent of the base 30.

In accordance with the present invention the handle member 28 is assembled with the window shade 18 into the tubular package envelope 12 in such a way that the handle member is generally aligned with the heat seal 14 so that the handle member plane of symmetry 39 is coplanar with the longitudinal extent of the heat seal 14 and the plastic film envelope 12 may be provided with holes 40 and 41 which are aligned with the holes 36 and 38 in the handle member. The display package 10 may be supported on a conventional display rack such as the rack 42, illustrated in FIG. 1, having a generally horizontally extending support rod 44 for supporting one or more of the packages 10 suspended generally adjacent to a backboard 46 of the display rack. In this way the weight of the shade 18 and any downward pulling forces exerted on the package 10 may be distributed over a relatively large area of the package envelope 12 which is engaged with the curved based portion 30 of the handle member 28. The display package 10 does not require the provision of separate reinforcing means such as a plastic or cardboard reinforcing member since the shade handle member 28 serves as a reinforcing and load distributing support member for the package. Although the holes 40 and 41 may be punched in the tubular envelope 12 prior to insertion of the shade 18 and the handle member 28 into the interior of the package envelope a skilled stocking clerk could relatively easily insert the rod 44 through the holes 36 and 38 by merely piercing the package envelope in the vicinity of the holes in the handle member as the individual packages 10 are being installed on the rack support rods.

Those skilled in the art will appreciate from the foregoing description that a particularly unique reinforced plastic display package for window shades is provided by the present invention wherein a novel combination of shade pulldown handle member, window shade and plastic envelope are provided. The handle member 28 serves one purpose during display of the shade 18 prior to purchase and serves it conventional purpose once the shade 18 and the handle member 28 are removed from the package and put to use.

In a preferred method of packing the shade 18 and the handle member 28 within the tubular envelope 12 the envelope is preferably cut from a continuous tube of plastic film, not shown, to a predetermined length and the shade 18 and handle member 28 inserted therein. The heat seal 16 may be formed before insertion of the shade and handle member or thereafter or conversely the heat seal 14 may be formed at the other end of the tube 12 followed by insertion of the handle member 28 into the interior of the tube so that the longitudinal extent of the handle member 28, as indicated by the dimension L in FIG. 2, is aligned with the heat seal 14, followed by insertion of the shade 18 into the interior of the tube 12. The heat seal 16 may then be formed to close the package and at a predetermined distance from the heat seal 14.

The contents of the package 10 comprising the shade 18 and the handle 28 are thus not permitted to move longitudinally within the envelope 12 a sufficient distance to allow turning of the handle member so that its plane of symmetry 39 becomes normal to the heat seal 14. In this way the handle member 28 will not be allowed to turn crosswise to the heat seal 14. As mentioned previously, holes 40 and 41 may be formed in the envelope 12 at a predetermined distance from the end of the envelope adjacent the heat seal 14 and of course at a predetermined distance from the heat seal 16 so that the holes 40 and 41 will be aligned with the holes 36 and 38 in the handle jaw portions 32 and 34.

Although a preferred embodiment has been described herein those skilled in the art will recognize that various substitutions and modifications may be made to the specific display package and method described without departing from the scope and spirit of the present invention as recited in the appended claims.

What I claim is:

1. In combination: an elongated rolled window shade and the like, an elongated flexible envelope for receiving said shade in supportive and protective relationship thereto during display of said shade for the merchandising thereof, and a handle member for said shade disposed within said envelope and oriented for supporting said envelope on a display rack rod to distribute the weight of said shade over a portion of said envelope when supported on said rod.

2. The combination set forth in claim 1, wherein:
said envelope comprises an elongated plastic film tube closed at its opposite ends to contain said shade and said handle member, and said handle member is disposed within said tube at one end thereof and contiguous with said tube to support said shade in a generally vertically hanging position.

3. The combination set forth in claim 2, wherein:
said handle member includes a curved base portion and opposed elastically deflectable jaw portions, and said handle member is disposed in said tube whereby said curved base portion is engageable with a closed end of said tube to support and distribute the load of said shade over said one end of said tube.

4. The combination set forth in claim 3, wherein:
said jaw portions include opposed holes formed therein for receiving said rod and wherein said rod extends through said envelope generally transversely.

5. The combination set forth in claim 4, wherein:
said envelope is provided with holes formed therein and aligned with said holes in said handle member to permit insertion of said rod substantially transversely through said envelope.

6. The combination set forth in claim 4, wherein:
said envelope is formed to have a substantially linear transverse heat seal formed at said one end, said heat seal being coextensive with the longitudinal extent of said base portion of said handle member.

7. The combination of a window shade and a removable pulldown handle member for said window shade in a display package therefor, comprising: an elongated rolled window shade member having a hemmed end and an elongated substantially rigid slat disposed in said hemmed end;

a molded plastic shade pulldown handle member including a curved base portion and opposed integral jaws, said jaws being elastically deflectable with respect to each other to permit insertion of said slat within said hemmed end between said jaw members for securing said handle member on said shade; and an elongated tubular plastic film display package for said shade member and said handle member comprising a tubular plastic film envelope which is formed with generally transverse heat seals at both ends to close said envelope with said shade member and said handle member disposed within said envelope in such a way that said handle member is removed from said shade member and is oriented at one end of said envelope and is engageable with a support rod or hook means on a display rack or the like for supporting said combination in said package while minimizing the chance of tearing said film due to the weight of said shade member and spurious forces exerted on said package.

8. The combination set forth in claim 7, wherein:

the diameter of said envelope and the distance between said heat seals are such that said handle member is confined in said envelope to be aligned with one of said heat seals at one end of said envelope whereby a plane of symmetry passing through said handle member is substantially coplanar with said one heat seal.

9. A method of providing a reinforced display package for a window shade and removable pulldown handle member for said window shade comprising the steps of:

providing a window shade;

providing a removable handle member for said window shade;

providing an elongated envelope package for said handle member and said window shade;

inserting said handle member and said window shade in said envelope; and closing said envelope to confine said window shade and said handle member therein and wherein said handle member is oriented to be engaged with means for hanging said envelope to display the contents of said envelope.

10. The method set forth in claim 9, wherein:

said envelope is formed from a plastic film tube and is closed at opposite ends by forming substantially transverse heat seals, and the step of inserting said handle member into said envelope comprises orienting said handle member to be substantially coextensive with one of said heat seals.

* * * * *